US006030166A

United States Patent [19]

Chin-Chang et al.

[11] Patent Number: 6,030,166

[45] Date of Patent: Feb. 29, 2000

[54] MECHANISM FOR LOADING A LASHING TAPE OF A BINDING MACHINE

[75] Inventors: Liu Chin-Chang; Su Chi-Chan, both of Taichung, Taiwan

[73] Assignees: Tekpak Corporation, Taichung; Transpak Equipment Corp., Taipei, both of Taiwan

[21] Appl. No.: 09/318,070

[22] Filed: May 24, 1999

[51] Int. Cl.[7] ..... B42B 5/04

[52] U.S. Cl. ..... 412/36

[58] Field of Search ..... 412/8, 22, 36, 412/37, 900, 901, 902

[56] References Cited

U.S. PATENT DOCUMENTS

| | | | |
|---|---|---|---|
| 2,532,535 | 12/1950 | Biesen | 412/36 |
| 4,531,873 | 7/1985 | Voge | 412/36 |
| 4,861,212 | 8/1989 | Cordia | 412/36 |
| 4,904,333 | 2/1990 | Zultnen | 412/36 X |
| 5,697,747 | 12/1997 | Sawada et al. | 412/36 X |

*Primary Examiner*—Willmon Fridie, Jr.
*Attorney, Agent, or Firm*—Harrison & Egbert

[57] ABSTRACT

A mechanism for loading a lashing tape of a binding machine is disposed on a tape storing slot which is located in the binding machine and formed of a locating plate and a position confining plate. The locating plate is provided with a drive wheel driven by a drive motor, and a driven wheel located near the drive wheel. The locating plate is pivoted with a main guide rod. The driven wheel is fastened with an auxiliary guide rod. The main guide rod is connected with a control rod for controlling a touch switch regulating the circuit of the drive motor. The auxiliary guide rod is slanted in a direction toward the main guide rod. The main guide rod is pushed by an actuating rod driven by a motor such that the main guide rod swivels upward to join with the auxiliary guide rod, thereby resulting in the formation of a gap via which the lashing tape is guided by the drive wheel and the driven wheel to be loaded.

4 Claims, 7 Drawing Sheets

MECHANISM FOR LOADING A LASHING TAPE OF A BINDING MACHINE

FIELD OF THE INVENTION

The present invention relates generally to a binding machine, and more particularly to a mechanism for loading a lashing tape of the binding machine.

BACKGROUND OF THE INVENTION

As shown in FIG. 1, a prior art binding machine is loaded with a lashing tape 10 which is wound on a reel 11 such that the lashing tape 10 is put into the binding machine in conjunction with a plurality of guide wheels 12. The loading of the lashing tape 10 is done manually and is therefore inefficient and time-consuming. In addition, the prior art device for loading the lashing tape 10 is complicated in construction and is therefore not cost-effective.

SUMMARY OF THE INVENTION

The primary objective of the present invention is to provide a binding machine with an efficient mechanism for loading a lashing tape with ease and speed.

It is another objective of the present invention to provide a binding machine with a simple and cost-effective mechanism for loading a lashing tape.

The objectives, features and functions of the present invention will be readily understood upon a thoughtful deliberation of the following detailed description of a preferred embodiment of the present invention with reference to the accompanying drawings.

DETAILED DESCRIPTION OF THE EMBODIMENT

Figure 1:
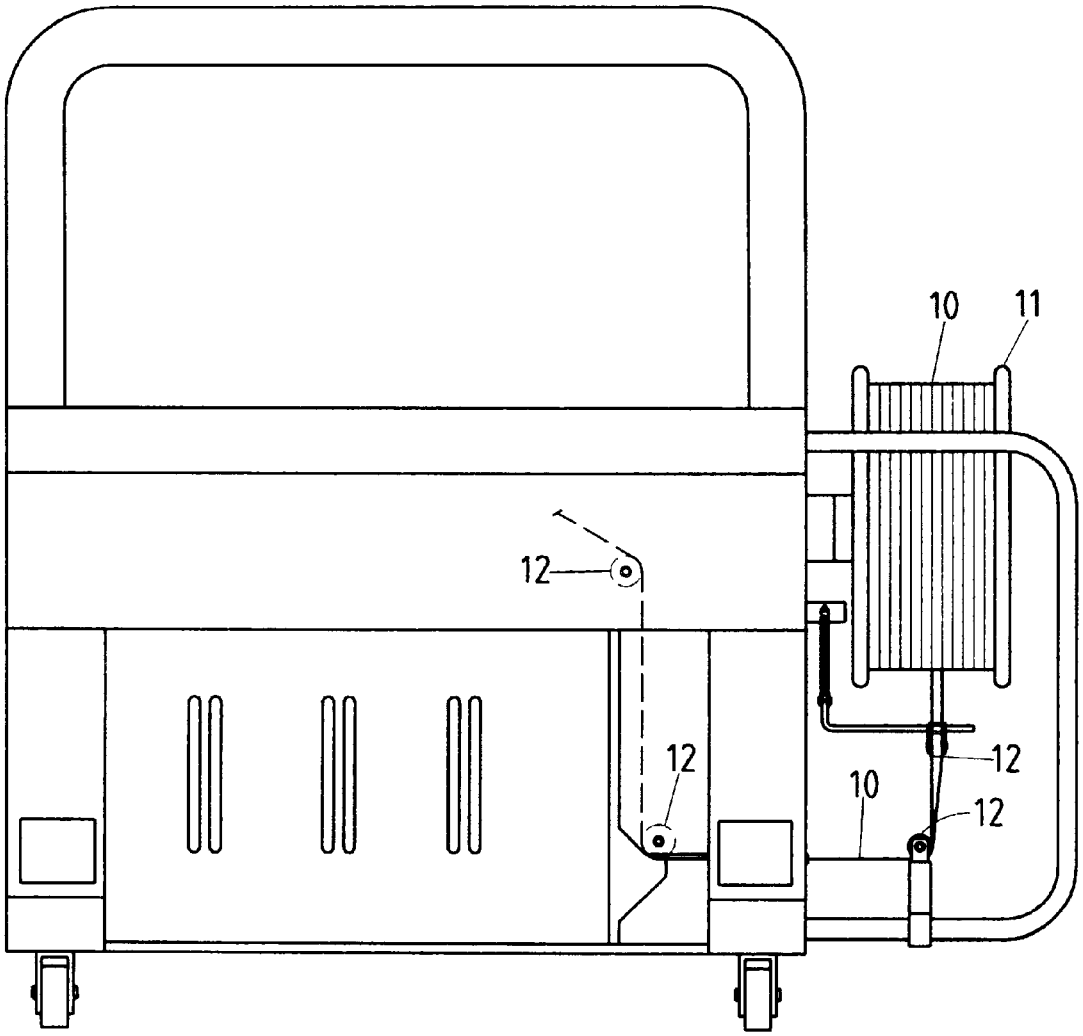
FIG.1 (PRIOR ART)
FIG. 1 shows a schematic view of a prior art device for loading a lashing tape of a binding machine.
Figure 2:
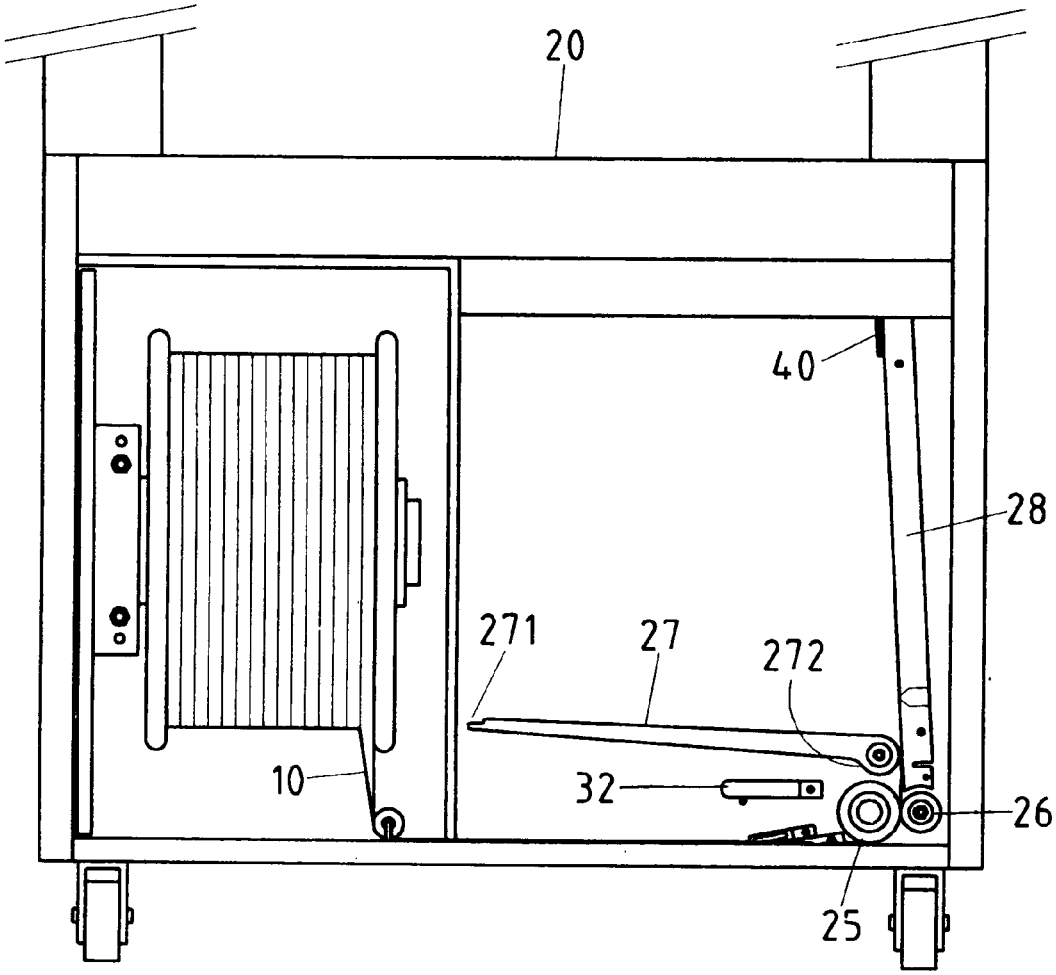
FIG. 2 shows a schematic view of the preferred embodiment of the present invention.
Figure 3:
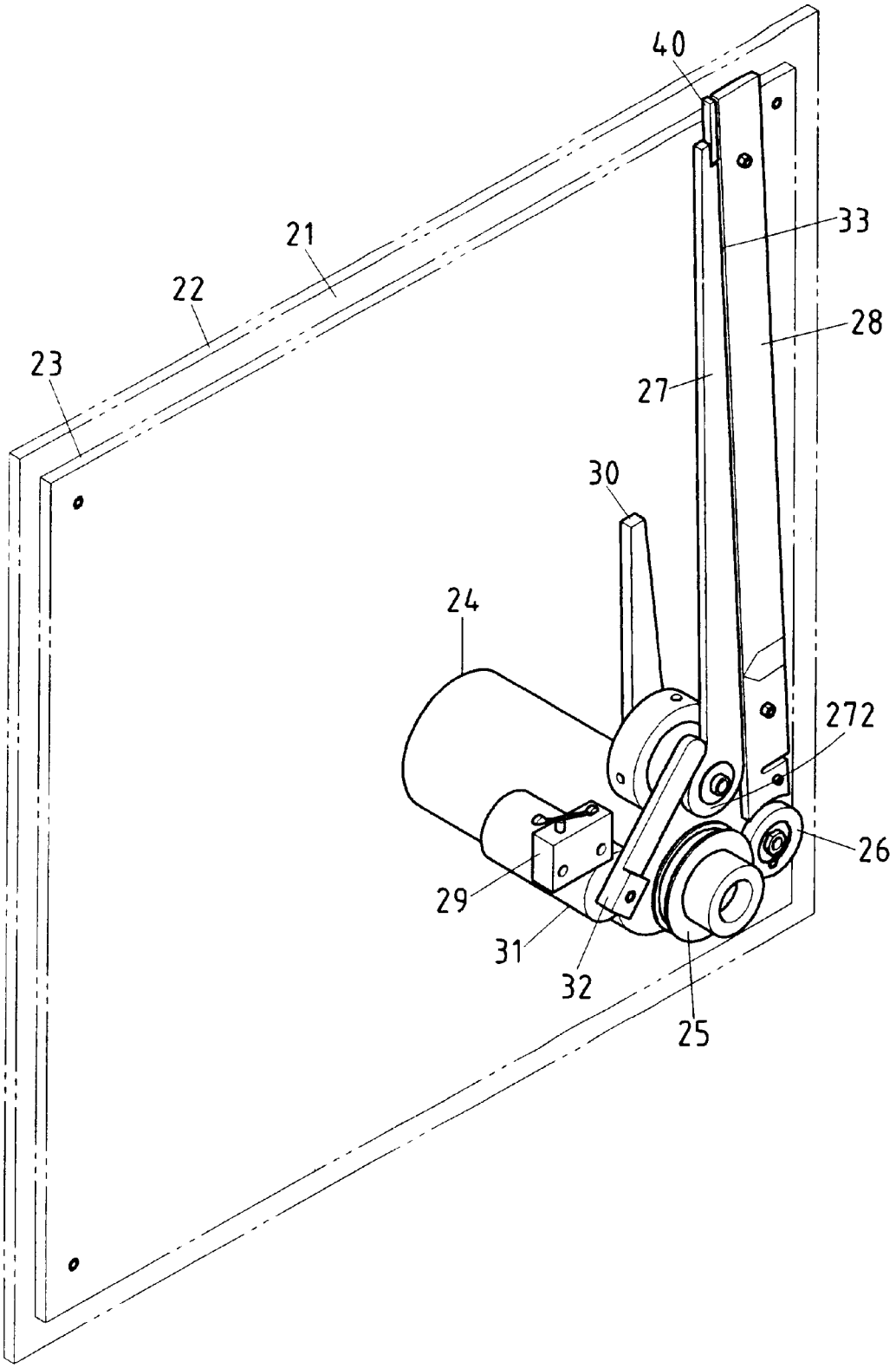
FIG. 3 shows a perspective view of the preferred embodiment of the present invention.

As shown in FIGS. 2 and 3, a loading mechanism of the preferred embodiment of the present invention is disposed on a tape storing slot 21 of a binding machine 20. The tape storing slot 21 is formed of a locating plate 22 and a position confining plate 23. The locating plate 22 is provided in the proximity of a corner of the bottom of the surface thereof with a drive wheel 25 which is driven by a motor 24. Located near the drive wheel 25 is a driven wheel 26. The locating plate 22 is pivoted with a main guide rod 27. The driven wheel 26 is fastened with an upright auxiliary guide rod 28. The main guide rod 27 is connected at the bottom end thereof with a control rod 30 capable of triggering a touch switch 29 for starting or stopping the motor 24. The auxiliary guide rod 28 is slanted toward the main guide rod 27. Located near the drive wheel 25 is an actuating rod 32 driven by the motor 31 to push the main guide rod 27 to swivel upward to join with the auxiliary guide rod 28. After the main guide rod 27 and the auxiliary guided rod 28 are joined together, there is a gap 33 for the drive wheel 25 and the driven wheel 26 to guide the lashing tape 10 to be loaded upward. The auxiliary guide rod 28 is fastened at the top end thereof with a stop block 40. The main guide rod 27 is provided at the top end thereof with an indentation 271 which can be stopped by the stop block 40 at the time when the main guide rod 27 and the auxiliary guide rod 28 are joined together such that there is the gap 33 through which the lashing tape 10 is guided. The position confining plate 23 is preferably made of a transparent plate.

The actuating rod 32 is located in the proximity of the drive wheel 25 at the time when the actuating rod 32 is located under the main guide rod 27 which is disposed horizontally at the bottom of the tape storing slot 21.

Figure 4:
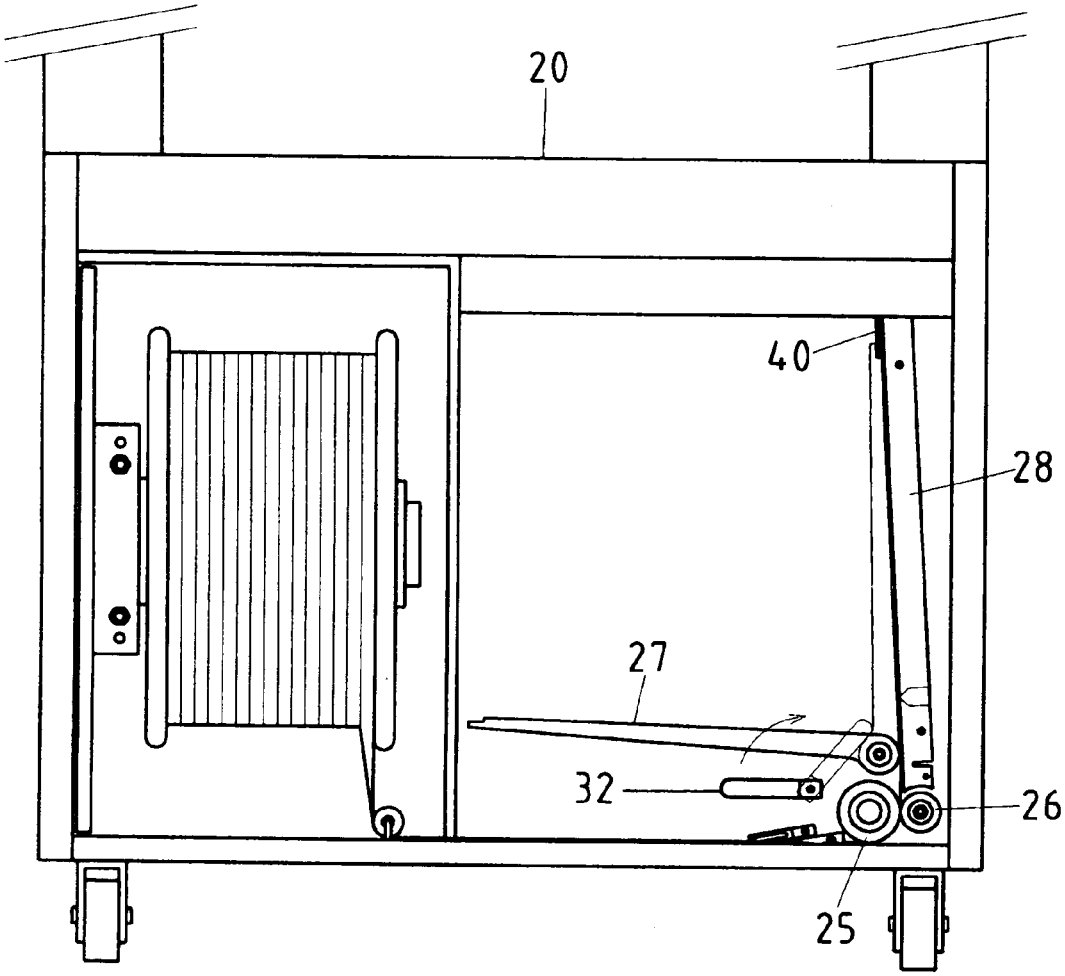
FIG. 4 shows a schematic plan view of the preferred embodiment of the present invention in operation.
Figure 5:
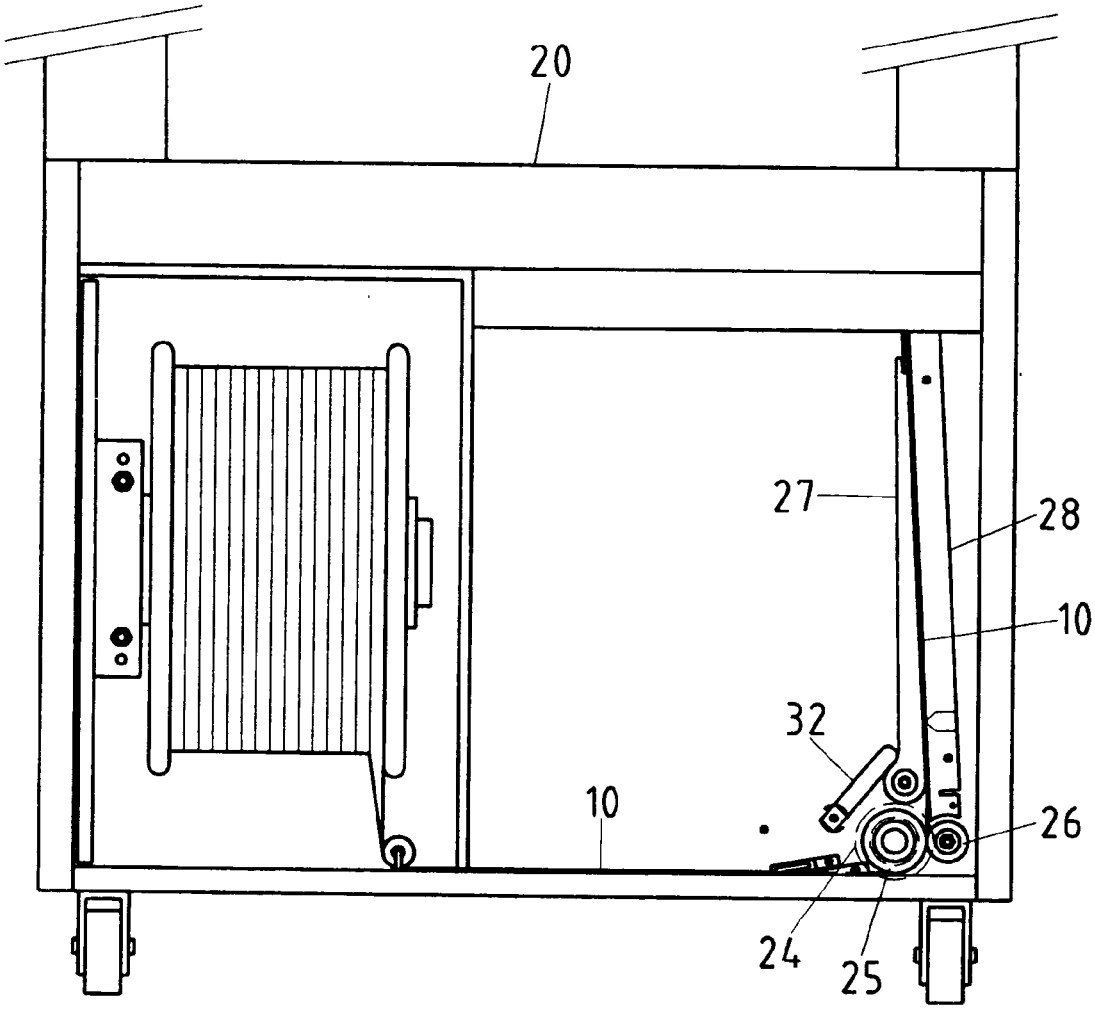
FIG. 5 shows another schematic plan view of the preferred embodiment of the present invention in operation.
Figure 6:
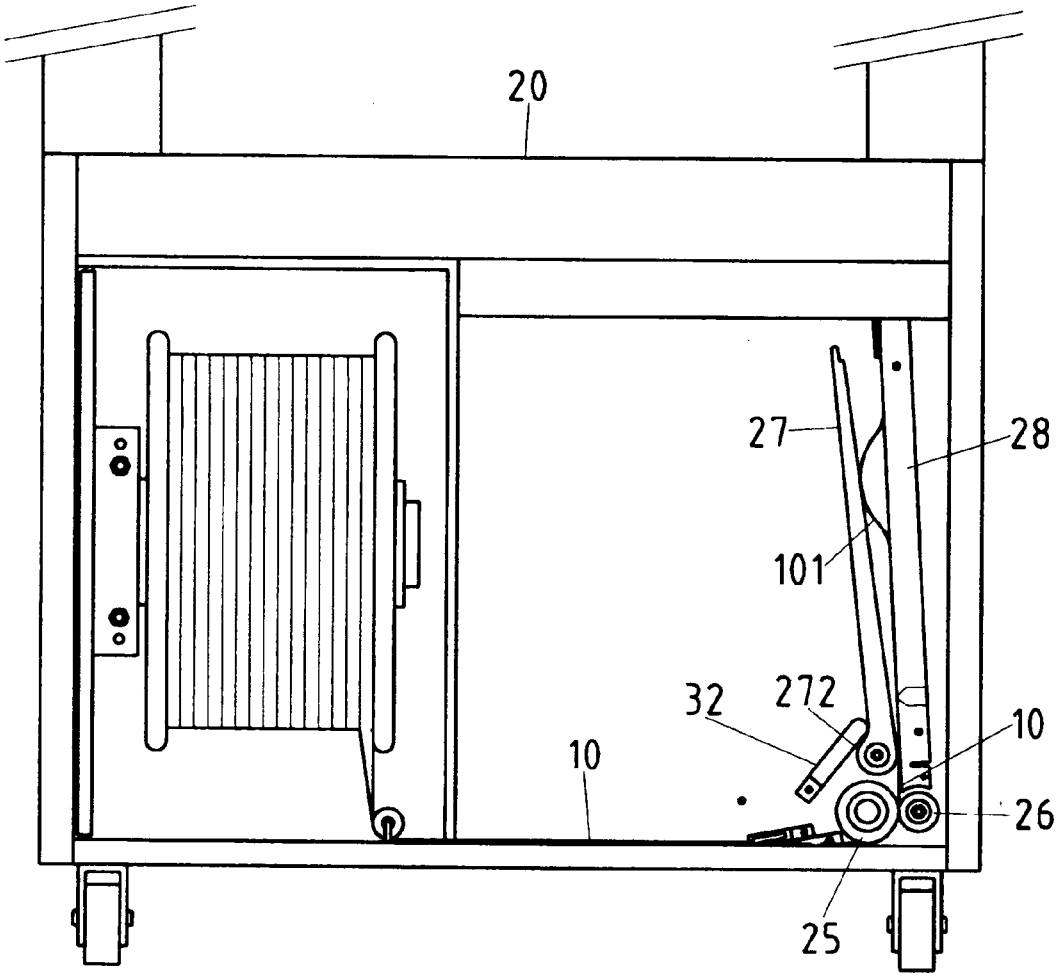
FIG. 6 shows still another schematic plan view of the preferred embodiment of the present invention in operation.
Figure 7:
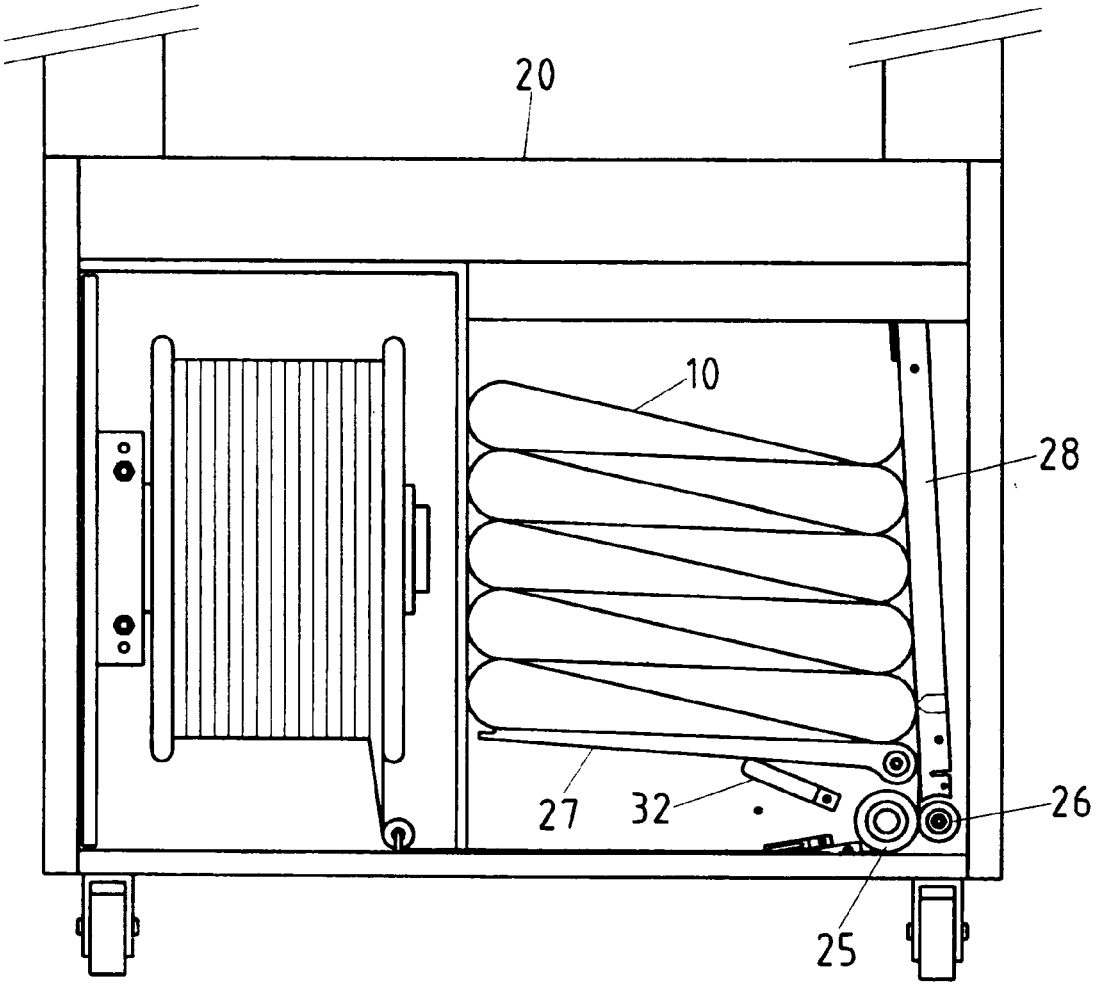
FIG. 7 shows a schematic plan view of a lashing tape that is completely loaded in a binding machine according to the preferred embodiment of the present invention.

As shown in FIGS. 3 and 4, before the lashing tape 10 is guided into the interior of the tape storing slot 21, the motor 31 is started to drive the actuating rod 32 to swivel upward such that the main guide rod 27 is pushed by the actuating rod 32 to swivel upward so as to join with the auxiliary guide rod 28. As soon as the main guide rod 27 and the auxiliary guide rod 28 have joined together, the motor 31 is stopped. In the meantime, the lashing tape 10 is pulled out of the reel 1 such that the lashing tape 10 is put between the drive wheel 25 and the driven wheel 26, and that the lashing tape 10 is put into the gap 33 which is formed between the main guide rod 27 and the auxiliary guide rod 28. The motor 24 can be then started to drive the drive wheel 25 such that the driven wheel 26 is driven by the drive wheel 25 so as to roll the lashing tape 10 along the gap 33 to move into the tape loading system of the binding machine 20. As the end of the lashing tape 10 is arrested, the lashing tape 10 is kept being rolled upward, thereby resulting in the lashing tape 10 being pushed in the gap 33 to form a projected tape 101, which pushed the main guide rod 27 to swivel downward. The actuating rod 32 is linked to swivel downward. In the meantime, the main guide rod 27 is forced by the weight of the lashing tape 10 to move downward, as shown in FIG. 7, until such time when the control rod 30 touches the touch switch 29 to shut off the motor 24. As a result, the lashing tape 10 stops being rolled by the drive wheel 25 and the driven wheel 26. The loading process of the lashing tape 10 is thus completed.

The present invention has advantages which are described hereinafter.

The auxiliary guide rod 28 is appropriately slanted so as to cause the center of gravity of the main guide rod 27 to direct slightly toward the recovery direction after the main guide rod 27 is joined with the auxiliary guide rod 28. As a result, the lashing tape 10 is pushed to form the projected tape 101 by means of which the main guide rod 27 is pushed to recover. Such a mechanism as described above is relatively simple in construction.

The lashing tape 10 of the present invention is actuated by the drive wheel 25 and the driven wheel 26 such that the lashing tape 10 is automatically guided upward via the gap 33 formed by the main guide rod 27 and the auxiliary guide rod 28 which are joined together. The guiding of the lashing tape 10 of the present invention is done with ease and speed.

The position confining plate 23 of the present invention is made of a transparent material to enable the process of loading the lashing tape 10 to be observed with the naked eye.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

We claim:

1. A mechanism for loading a lashing tape of a binding machine, the mechanism being disposed on a tape storing slot located in the binding machine and formed of a locating plate and a position confining plate, said locating plate provided at a corner of a bottom of a surface thereof with a drive wheel driven by a drive motor, and a driven wheel located near said drive wheel, said locating plate being pivoted with a main guide rod, said driven wheel being fastened at a top thereof with an upright auxiliary guide rod, said main guide rod connected at a bottom end thereof with a control rod for controlling a touch switch regulating the circuit of said drive motor; wherein said auxiliary guide rod is slanted in a direction toward said main guide rod, said main guide rod being pushed by an actuating rod driven by a motor such that said main guide rod swivels upward to join with said auxiliary guide rod, thereby resulting in formation of a gap via which the lashing tape is guided by said drive wheel and said driven wheel to be loaded.

2. The mechanism as defined in claim 1, wherein said actuating rod is located in the proximity of said drive wheel at the time when said actuating rod is located under said main guide rod which is disposed horizontally at the bottom of the tape storing slot.

3. The mechanism as defined in claim 1, wherein said auxiliary guide rod is fastened at a top end thereof with a stop block; and wherein said main guide rod is provided at a top end thereof with an indentation which is stopped by said stop block at the time when said main guide rod is actuated by said actuating rod to swivel upward to join with said auxiliary guide rod, thereby forming said gap.

4. The mechanism as defined in claim 1, wherein said position confining plate is formed of a transparent material.

* * * * *